United States Patent [19]

Teng et al.

[11] Patent Number: 4,533,606

[45] Date of Patent: Aug. 6, 1985

[54] ELECTRODEPOSITION COMPOSITION, PROCESS FOR PROVIDING A Zn/Si/P COATING ON METAL SUBSTRATES AND ARTICLES SO COATED

[75] Inventors: Yu-Ling Teng, Bayside, N.Y.; Charles McCoy, Pearland; Francis DeFalco, Houston, both of Tex.; Richard Mayernick, North Merrick, N.Y.

[73] Assignee: Kollmorgan Technologies Corp., Dallas, Tex.

[21] Appl. No.: 641,557

[22] Filed: Aug. 16, 1984

[51] Int. Cl.[3] ..... B32B 15/04; C25D 3/56

[52] U.S. Cl. ..... 428/658; 204/44.2; 420/513; 428/659

[58] Field of Search ..... 204/44.2; 428/658, 659; 420/513

[56] References Cited

U.S. PATENT DOCUMENTS 4,117,088 9/1978 Merkl ..... 423/299

FOREIGN PATENT DOCUMENTS 378545 4/1973 U.S.S.R. ..... 204/44.2

412297 1/1974 U.S.S.R. ..... 204/44.2

*Primary Examiner*—G. L. Kaplan

*Attorney, Agent, or Firm*—Morgan, Finnegan, Pine, Foley & Lee

[57] ABSTRACT

The present invention provides an aqueous composition and process for the electrodeposition of a layer of zinc containing silicon and phosphorus on a metal substrate. The electrodeposition composition is prepared by reacting metallic silicon and zinc with phosphoric acid and an alkali metal hydroxide in the ratio of between 0.4 and 1.3 moles of alkali metal hydroxide per mole of phosphoric acid, and adjusting the solution to a pH of 2 or higher after completion of the reaction. The coating is deposited on the metal substrate by electrodeposition and comprises about 70% to about 99.5% by weight of zinc, and about 0.10% to about 10% by weight of silicon, and about 0.5% to about 20% by weight of phosphorus.

The resultant zinc/silicon/phosphorus coating improves the resistance of the metal substrate to corrosion, wear, galling and stress corrosion cracking. While essentially all metals of industrial importance may be coated, this process is especially important for ferrous metals, steels, stainless steels, copper, aluminum and titanium. The coated metal substrates are useful in various industries, including appliance, automobile, oil field equipment, nuclear reactor equipment, aerospace equipment, etc.

19 Claims, 5 Drawing Figures

Scanning Electron Microscope Photographs Of Zinc/Silicone Phosphorous Coatings

Fig. 1.
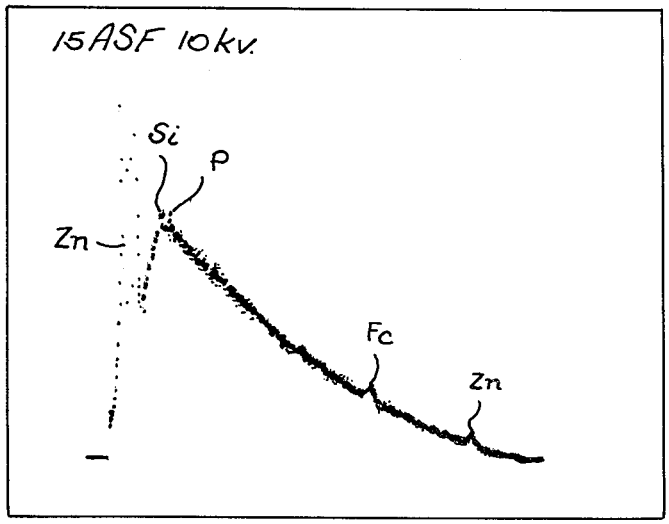
SCANNING ELECTRON MICROSCOPE PHOTOGRAPHS OF ZINC/SILICONE PHOSPHOROUS COATINGS
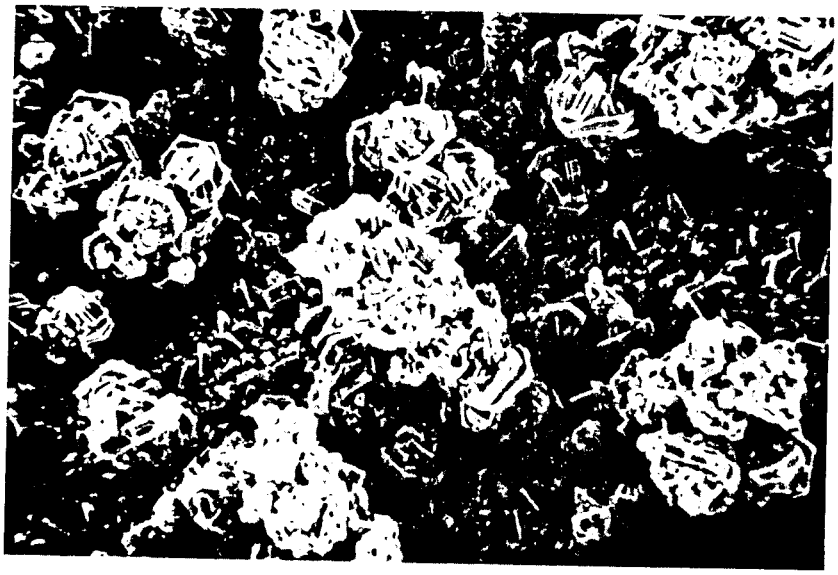
Fig. 2.

ELECTRODEPOSITION COMPOSITION, PROCESS FOR PROVIDING A Zn/Si/P COATING ON METAL SUBSTRATES AND ARTICLES SO COATED

INTRODUCTION

The present invention relates to an aqueous composition and process for electrodepositing a layer of zinc containing silicon and phosphorus on a metal substrate to improve wear resistance; protect against galling; and to improve resistance of the metal against corrosion and stress corrosion cracking. While essentially all metals of industrial importance may be plated, this process is especially important for ferrous metals, steels, stainless steels, copper, aluminum and titanium.

BACKGROUND OF THE INVENTION

Many attempts have been made in the past to improve the surface properties of metals in order to widen their applications. An early attempt was to improve corrosion resistance by coating one metal with one or more suitable metals. For instance, base metals have been coated with silver and/or gold, and iron has been coated with tin.

It is also known to use zinc or cadmium to protect iron or steel galvanically against corrosion.

A known process for providing an adherent, protective coating of zinc or zinc compounds on iron or steel is by hot dip galvanizing. This involves immersing the iron or steel object in a bath of molten zinc. However, the degree of protection provided by this process is highly dependent on the bath temperature, immersion time, rate of cooling or subsequent reheating. Moreover, the strength and impact toughness of the substrate is generally reduced, and the zinc coating tends to craze or crack if the hot dip galvanized substrate is subsequently formed by sharp bending.

Processes to electroplate a layer of zinc on steel have also been suggested. However, it is recognized that the protective effect of a zinc coating on steel is mainly sacrificial protection and only partially provided by the formation of an insoluble surface coating. The degree of protection against corrosion depends on the formation of an insoluble basic carbonate film. Any condition which interferes with the formation of this film will lead to rapid attack of the zinc coating and negate the protective effects provided. Further, zinc plating has proven to be unsatisfactory for protection against the corrosive effects of severe industrial environments.

Besides providing corrosion resistance, metals have been coated with cadmium to provide lubricity, solderability, and compatible electrical conductivity. Products coated with cadmium have found application particularly in the aerospace and automobile industries. Cadmium coated steels are used in aircraft, aerospace fasteners, disc-brake components, radiator hose fittings, door latches and torsion-bar bolts. However, because of the toxicity of cadmium and the potential health hazards resulting therefrom, there are stringent federal and local regulations controlling the use of cadmium. This limits its application and increases its cost.

With the growth in use of metals in many industries, methods of joining metals together have been found to be essential. This led to the use of fasteners such as bolts, screw, springs, pins, etc. Many of these rely upon the use of threaded parts which are subjected to high torque loads to keep the metal components from pulling apart or becoming unfixed.

However, it has been found that when the threaded parts are highly torqued, they become susceptible to corrosion, such as by hydrogen sulfide attack, hydrogen embrittlement, chloride corrosion, stress corrosion cracking and oxidative attack.

To protect against such corrosive attacks, methods of plating or coating the threaded parts have been developed.

It is important that the coating or plating on the threaded parts be very thin so that it does not interfere with the thread make up. It is also important that the coating or plating adhere to the base metal, to provide a low coefficient of friction and protect against corrosive attack.

Methods of coating or plating threaded parts most commonly used today are galvanizing, zinc plating, phosphating, cadmium plating or coating with fluorocarbon polymers. However, these methods suffer from many disadvantages.

As an example, an ASTM B-7 bolt should have a maximum tensile strength of 80,000 lbs. and a usable temperature range of subzero to 600° C.

Galvanizing can only provide a coating with a tensile strength of about 40,000 lbs. The deposited layer is thick and special nuts are required for thread make up. Further, the smallest breakdown in the coating provides sites for accelerated corrosion whereby the nuts and bolts fuse together resulting in extra expenses for removal during maintenance.

Zinc electroplating also provides poor tensile strength and low resistance to corrosion.

Cadmium electroplating can provide a tensile strength of 70,000 lbs. and a low coefficient of friction. However, it only provides moderate protection against corrosion and any breakdown in the coating accelerates corrosive attack. And as stated previously, cadmium is highly toxic with severe environmental implications.

Phosphating can provide good mechanical properties, and act as a substrate for paints and fluorocarbon polymer coatings. However, by itself, phosphating does not provide sufficient protection against corrosion.

Fluorocarbon polymer coatings do provide good corrosion resistance and a low coefficient of friction. However, the usable temperature range is very limited and fluorocarbon polymers tend to flow excessively under stress.

Therefore, there is a critical need for a coating that is resistant to corrosion and will prevent galling, particularly in the oil exploration field.

Galling is a problem encountered frequently in oil and gas exploration. Galling describes a phenomenon when threads of connectors become forged or welded together as a result of having been subjected to high torque loading.

In the oil and gas exploration field increasing depths of drilling have been found to be necessary to obtain much needed energy resources. High temperatures and pressures coupled with aggressively corrosive environments such as hydrogen sulfide, hot boiling chlorides, carbon dioxide gas have compounded the problems of oil exploration and expensive metal alloys have been developed to meet the challenge.

Since it is not uncommon to drill wells of 15,000 feet or deeper, drilling pipes must be threaded together. Further, tool joints, pulsation dampers, blow out preventers, valves, electric measuring devices are used and all of these have threaded connections. The galling of threaded connections has been a severe problem in oil and gas exploration causing increased expenses in time and money.

Attempts have been made to overcome this problem with specially designed pipe threads and coatings such as electroless nickel, hard chromium. However, none of the coatings provide a satisfactory solution since most of the coatings break down under the high stress load required, and some of the coatings such as electroless nickel or hard chromium have uneven throwing power which leads to distortion of threaded parts which are specially designed to have close tolerance.

It has been found that the zinc/silicon/phosphorous deposit according to the present invention is surprisingly effective against corrosion of threaded joints and is particularly suitable for applications in the oil exploration field.

Another serious problem recently encountered is stress corrosion cracking of high strength alloys. These high strength alloys have been used in many different areas from satellites and space vehicles to cars, bridges and nuclear reactors. It is recognized that stress corrosion cracking is related to hydrogen embrittlement or attack by sulfides and chlorides in the environment. Sulfide induced stress corrosion cracking is generally considered to be a result of hydrogen embrittlement. When hydrogen atoms evolve cathodically on the surface of a metal, as a result of corrosion, the presence of hydrogen sulfide causes the hydrogen atoms to stay within the surface of the metal. These hydrogen atoms diffuse to regions of high triaxial tensile stress or regions where the microstructural configuration causes the hydrogen atoms to be trapped. The presence of hydrogen atoms increases the brittleness of the metal. Stress failure has been the major cause of airplane and auto crashes, and flaws in bridges and nuclear reactors. Up to the present, no viable solution to stress corrosion cracking of high strength alloys has been provided.

It has been found further that the zinc/silicon/phosphorus coating according to the present invention can improve the stress corrosion cracking resistance of these high strength alloys.

Wear and friction are also serious problems in metal engine components, where parts are in contact with each other, especially piston rings, cylinders, and auto transmission shafts. The rate of wear is directly related to the amount of friction between two moving components. Lubricants are used to reduce friction. However, in certain cases, lubricant oils may interfere with the function of the parts; furthermore dirty lubricant oils must be changed frequently, thus increasing the cost of operation and present disposal problems. Since the zinc-/silicon/phosphorus coating provides a low coefficient of friction, it is particularly useful on metal parts which are in contact with each other.

The recognition of the need to improve resistance to corrosion, galling, wear, and stress corrosion cracking has led to the development of many methods of improving the surface characteristics of metals. One such known method is to "siliconize" metal substrates by exposing the metal substrate to high temperatures, in the range of 800°–1400° C., in an atmosphere of silicon tetrachloride and hydrogen. Alternatively, metal substrates may be siliconized by heating the metal substrates in the presence of silicides at a temperature sufficient to cause thermal decomposition of the silicide. Such siliconized metal substrates are found to be highly resistant to oxidative attack, and possess anti-corrosion characteristics.

However, these processes consume extremely high amounts of energy and are difficult to control and are impractical.

Research data in phosphorus implantation have been reported to show improved corrosion resistance of stainless steel. However, this process requires expensive and sophisticated processing equipment and at the present time, is impractical for use in production.

Surprisingly, it has been found according to the present invention that a zinc/silicon/phosphorus coating can provide a solution to all of the above problems. The zinc/silicon/phosphorous coating has a low coefficient of friction, equivalent to that provided by cadmium. The coating adheres well and is not destroyed when subjected to full torque and tensile loading. Further, only a layer of 0.2 to 0.3 mil thickness is sufficient to provide excellent corrosion resistance. The coating can be deposited on any conductive substrate, including but not limited to aluminum, titanium, chromium, stainless steels and alloys, high strength metals used by the aerospace industry. Moreover, the coating eliminates galling problems associated with high strength alloy steels.

Another area where the present invention has application is in the plating of difficult to plate metal substrates, such as aluminum, titanium and stainless steel. Up to the present, it is difficult to obtain good adhesion to these metal substrates because of the presence of a film of metal oxide on the surface. The metal oxide film can be removed by immersion in acidic or alkaline solutions. However, the oxide film re-forms immediately when the metal substrate is removed from the de-oxidizing solution. Although methods to improve adhesion are available, these generally involve additional processing steps and increased production costs.

For example, in the production of magnetic recording discs, aluminum is provided with a layer of electroless nickel to provide adhesion for subsequent deposition of a magnetic coating. However, nickel is expensive and it provides a hard surface which is difficult to grind smooth for subsequent processing.

Although stainless steel is easier to plate than aluminum, the formation of an adherent coating by electrodeposition is extremely difficult. In fact, stainless steel is frequently used as the substrate when it is desired to form a coating which can be subsequently removed from the substrate for mechanical testing. The process for electrodepositing a coating on stainless steel involves several pickling steps prior to electrodeposition and, even then, a post-bake step is necessary to achieve an adherent deposit.

Titanium is extremely difficult to plate because of the formation of an extremely stable oxide film, which prevents the formation of an adherent coating. Therefore, the pickling step to remove this stable oxide film is even more crucial, and hydrofluoric acid is often used. Clearly, this is undesirable because of the corrosive nature and the danger of this solution.

It is desirable, therefore, to provide electrodeposition methods for the plating of these metals.

Attempts to electroplate silicon have been made in research laboratories. Unfortunately, these processes require the use of extremely high temperatures or of non-aqueous solvents. The former results in high energy consumption, while the problem of water removal and waste disposal has to be overcome with non-aqueous solvents.

Recently, three patents have issued describing methods of producing inorganic multi-metal polymeric complexes containing hydrophosphide groups in aqueous solutions. U.S. Pat. No. 4,029,747 described a polymeric-metal complex of a non-alkaline metal and an alkali metal in ammonia, for example silicon-sodium in ammonia and aluminum/sodium/calcium complex in ammonia. U.S. Pat. No. 4,117,088 describes an inorganic polymeric metal complex of non-alkaline metal of Group I-VIII, an alkali metal and a phosphorous compound in aqueous solutions. Specifically, Example 11 discloses a silicon-sodium-phosphorus polymeric complex. U.S. Pat. No. 4,117,099 describes an inorganic polymeric metal complex of non-alkaline metal of Group I-VIII, an alkali metal and a sulfur containing compound.

It is indicated that the polymeric solutions may be useful in plating. Specifically U.S. Pat. No. 4,029,747 suggests that the complexes may be used to plate silicon. U.S. Pat. No. 4,117,088 does not disclose or suggest the plating of silicon, and it was found that a solution prepared according to Example 11 of U.S. Pat. No. 4,117,088 did not produce an electrodeposit of silicon. Surprisingly, the applicants found that when zinc ions were added to the silicon-containing solutions, silicon was co-deposited with zinc. It is to be noted, however, none of the disclosures in these patents suggest that a co-deposit of silicon and phosphorus with zinc by electrodeposition can be obtained.

It is an object of the present invention to provide an economical and practical method to improve the resistance of metals to corrosion, wear, galling and stress corrosion cracking.

It is another object of the present invention to provide a method of electrodepositing a zinc/silicon/phosphorus coating on metal to improve the resistance of the metal to corrosion, wear, galling and stress corrosion cracking.

It is a further object of the present invention to provide an aqueous composition to electrodeposit a zinc-/silicon/phosphorus coating on metals including difficult to plate metals, such as aluminum, stainless steel and titanium.

It is another object of the present invention to electrodeposit reliably silicon - comprising coatings.

It is a further object of the present invention to provide a metallic article having a surface coating comprising zinc/silicon/phosphorus.

BRIEF DESCRIPTION OF THE INVENTION

According to the present invention, methods and aqueous compositions suitable for electrodepositing a co-deposit of zinc/silicon/phosphorus on various metal substrates have been developed.

The methods comprise preparing an aqueous solution suitable for electrodeposition, comprising about 0.5 g to about 50 g per liter of zinc, about 0.01 g to about 10 g per liter of silicon and about 10 g to about 250 g per liter of phosphorus.

The aqueous solution is prepared either by contacting zinc and silicon metals in the presence of each other with a phosphorus containing acid and alkali metal hydroxide or ammonium hydroxide, or by contacting the zinc and silicon metals with said acid and alkali in separate vessels and mixing the reaction product after the completion of the individual reactions.

Preferably the pH of the solution for electrodeposition is in the range of about 2 to about 5 or about 8 to about 14. More preferably, the pH is in the range of about 2.5 to about 4 and about 10 to about 12.

Further, it is preferred that the reaction is allowed to proceed for about 16 hours.

The aqueous solutions prepared according to the present invention is viscous.

The metal substrate to be coated by electrodeposition is cleaned and immersed in a solution prepared as decribed above. The metal substrate is connected as the cathode.

Using a current density of about 1 $A/dm^2$ (amps/-square decimeter) to about 7 $A/dm^2$ for about 20 minutes, a coating of about 10 microns on the metal substrate with at least about 70% by weight of zinc, at least about 0.10% by weight of silicon and at least about 0.5% by weight of phosphorus is obtained.

BRIEF DESCRIPTION OF DRAWINGS

FIG. 1 is a typical EDX spectrum of the surface of the steel substrate after electrodeposition using the solution according to the invention. The spectrum shows the presence of zinc, silicon and phosphorus in the surface layer of the steel.

FIG. 2 is a scanning electron microscope picture of the surface with zinc/silicon/phosphorus coating.

DETAILED DESCRIPTION OF THE INVENTION

Figure 3:
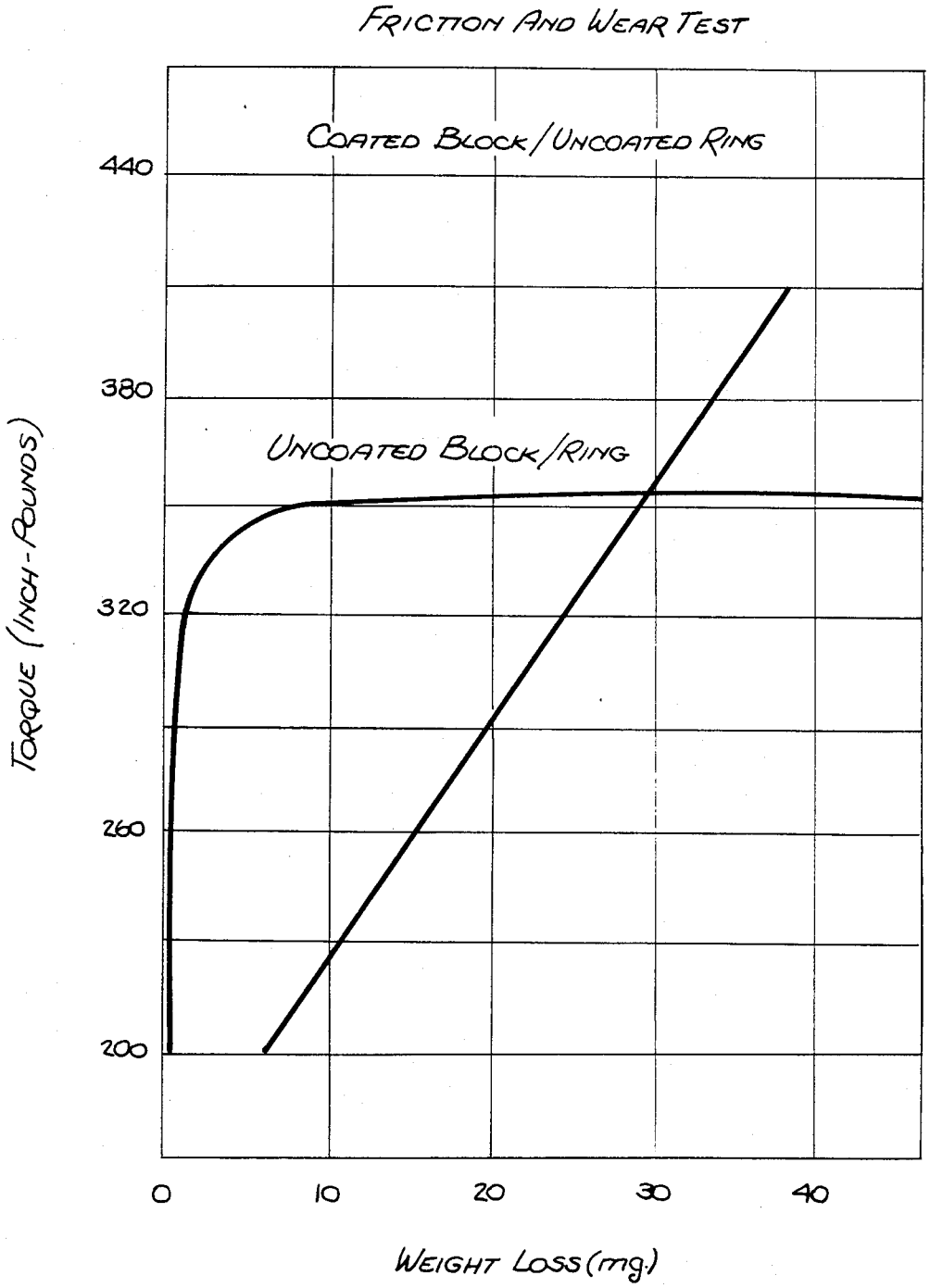
FIG. 3 is a graph plotting torque against loss of weight of the block in milligrams. This shows the degree of wear of the objects tested. The straight line shows the rate of wear of a coated block against an uncoated ring. The curve shows the rate of wear of an uncoated block against an uncoated ring.

According to the present invention, aqueous solutions can be used to electrodeposit a coating of zinc-/silicon/phosphorus on a metal substrate.

By using the solution prepared according to U.S. Pat. No. 4,117,088, it was found possible to electrodeposit zinc onto a metallic substrate. This was expected because zinc may be electroplated using a variety of known electrolytic zinc-containing solutions.

However, when the teaching described in U.S. Pat. No. 4,117,088 was used to prepare silicon-containing solutions, silicon-containing species were not electrodeposited. See Example 4.

Surprisingly, however, applicants found that when zinc-containing solutions were added to silicon-containing solutions, silicon was routinely and reliably co-deposited with zinc on the cathode. It was further found by applicants that when solutions are prepared according to the present invention, a co-deposit of zinc, silicon and phosphorous was formed on the surface. See Example 12. Thus, a composite deposit containing zinc, silicon, and phosphorus was formed by electrodeposition from these solutions.

Because a deposit containing these three species was unknown prior to the present invention, the properties of such a deposit were completely unknown. It was surprising to find superior galling-resistant, wear-resistant, corrosion-resistant and stress corrosion-resistant properties.

The solution according to the present invention comprises about 0.5 g to about 50 g per liter of zinc, about 0.01 g to about 50 g per liter of silicon and about 10 g to about 250 g per liter of phosphorus. Preferably, a solution for electrodepositing a zinc/silicon/phosphorus coating comprises about 1 g to about 20 g per liter of zinc, about 0.1 to about 10 g per liter of silicon and about 40 g to about 200 g per liter of phosphorus. More preferably, the solution for electrodeposition comprises about 10 g to about 20 g per liter of zinc, about 0.5 to about 2 g per liter of silicon and about 50 g to about 120 g per liter of phosphorus.

The aqueous solution is prepared either by contacting zinc and silicon metals with a phosphorus-containing acid and an alkali metal hydroxide or ammonium hydroxide in the presence of each other, or by contacting the zinc and silicon metals with said acid and alkali in separate vessels and mixing the reaction product after the completion of the individual reactions. Preferably, the silicon and the zinc metal is in the form of large granules.

In the first method, the aqueous solution is prepared by contacting silicon metal in the presence of zinc in an aqueous solution of a phosphorus-containing acid and adding an alkali metal hydroxide or ammonium hydroxide in increments until the pH is in the range of about 1.5 to about 14. The solution is allowed to react for from about 16 hours to a few days without stirring. Alternatively, the solution may be prepared by contacting silicon metal in the presence of zinc with concentrated alkali metal hydroxide solution and then adding a solution of a phosphorus-containing acid in increments until the pH is in the range of about 1.5 to about 14. The solution is then allowed to react for from about 16 hours to a few days without stirring. In both cases, the reaction continues until all the metal has dissolved, or, as is more common, the product solution is decanted from the excess metal when the desired metal ion concentration in the product solution is reached.

In the second method, zinc and silicon concentrated solutions are prepared separately, and the solutions are mixed after preparation. The separate concentrated solutions are first prepared by contacting zinc metal and silicon metal in separate vessels with a phosphorus containing acid and adding increments of an alkali metal hydroxide or ammonium hydroxide. Alternatively, the separate solutions can be prepared by contacting zinc metal or silicon metal with concentrated alkali metal hydroxide or ammonium hydroxide and then a phosphorus containing acid in increments. The pH of the mixture should be in the range of about 1.5 to about 14. The reaction is allowed to proceed for from about 16 hours to a few days without stirring. Again, the reaction continues until all the metal has reacted, or the product solution is decanted from the excess metal when the desired metal ion concentration in the product solution is reached. The zinc-containing solution is then mixed with the silicon-containing solution such that the ratio of zinc to silicon is in the range of about 8:1 to about 30:1.

The addition of alkali metal hydroxide to a phosphorus-containing acid or a phosphorus-containing acid to alkali metal hydroxide generates heat and raises the solution temperature. During the contacting of the metals with a phosphorus-containing acid and alkali metal hydroxide, the solution temperature should not exceed the boiling point of the solution and, preferably, should not exceed 80° C. The temperature can be controlled by controlling the rate of addition of the phosphorus-containing acid to the alkali mixture, the rate of addition of alkali metal hydroxide to the acid mixture, or by conventional cooling apparatus.

The alkali metal hydroxide is selected from a group consisting of sodium, potassium and lithium, preferably sodium or potassium. The phosphorus containing acid may be phosphorus acid, phosphoric acid or orthophosphoric acid, preferably orthophosphoric acid.

Alternatively, silicon metal is reacted with concentrated aqueous alkali metal hydroxide or ammonium hydroxide. The resulting product is then combined with a solution of zinc in phosphoric acid and allowed to react without stirring for several days.

Electrodeposition is carried out at a pH in the range of about 2 to about 14, preferably at a pH of about 2 to about 5 or about 8 to about 14, more preferably at a pH in the range of about 2 to about 4 or about 10 to about 12 and most preferably at a pH in the range of about 2.5 to about 3.5. The pH of the solution prepared according to the methods described above is adjusted by using a concentrated alkali metal hydroxide solution or concentrated phosphoric acid solution.

The deposition is carried out by electrodeposition. Insoluble anodes such as carbon or precious metal coated titanium (DSA anodes from Diamond Shamrock) as well as soluble anodes, e.g. zinc metal, may be used to co-deposit zinc/silicon/phosphorus from the solution of the present invention. The ratio of the area of the anode to the cathode should be about 1:1 or higher. The anode and cathode are placed about 7 cm to about 18 cm apart, preferably 10 cm apart. The current density is in the range of about 0.5 $A/dm^2$ to about 10 $A/dm^2$, preferably about 1.6 $A/dm^2$ to about 4 $A/dm^2$. Plating current densities higher than 10 $A/dm^2$ are possible when special agitation techniques are used, such as ultrasonic stirring or jet impingement.

Electrodeposition from a solution according to the present invention shows a cathodic efficiency of about 75%. At an optimium current density of about 3.3 $A/dm^2$ a layer of about 10 micron is deposited on a metal substrate in about 15 minutes. The pH and specific gravity of the solution remains almost unchanged even when the solution is depleted down to 50% of the amount of zinc, silicon or phosphorus initially present.

The depleted zinc and silicon in solution is replenished by addition of concentrated solution of zinc and silicon, or when a zinc anode is used, by addition of a concentrated solution of silicon. The required amount of zinc or silicon can be determined by an analysis of the amount of zinc or silicon remaining in the depleted solution. This analysis can be made either by wet or instrumental methods.

An electrodeposition bath according to the present invention has very good macro throwing power. However, for metal parts with intricate or special shapes, conforming anodes or auxiliary anodes may be required to provide sufficient micro throwing power.

The zinc/silicon/phosphorus coating of the present invention formed by electrodeposition is matte gray in color. If desired, the appearance of coated parts may be improved by dipping into a solution of about 0.5 to 1% nitric acid, rinsed with water and dried. It has been found the coated surface treated with nitric acid is whiter and smoother. The coated parts may also be subjected to chromate conversion coating process to provide a clear blue or gold finish. The chromate conversion coating process further improves the corrosion resistance of the parts with a zinc/silicon/phosphorus coating.

Parts which have been subjected to the electrodeposition process according to the present invention were analyzed by electron dispersive X-ray analysis (EDX) to determine the presence of zinc, silicon and phosphorus on the surface of the metal part. In this method, a selected area of the specimen is bombarded with electrons at a typical accelerating voltage of 10 to 30 Kev. The electron bombardment causes the emission of an X-ray spectrum of the characteristic X-ray lines of each of the elements present on the surface of the specimen.

It is believed that the coating should comprise at least about 70% by weight of zinc, at least about 0.1% by weight of silicon, and at least about 0.5% by weight of phosphorus. Preferably, the ranges should be 88% by weight of zinc, 9% by weight of silicon and 3% by weight of phosphorus. It is extremely difficult to measure the composition of surface coatings. EDX is a good compromise combining good sensitivity with reasonable cost and can be used for routine analysis. The coating is believed to contain oxygen in the form of metal oxides and of oxygenated-phosphorus moieties; however, oxygen is not detected by EDX. The EDX analysis is usually reported as percent by weight of zinc, silicon and phosphorus with a total of 100%, although it is actually the weight ratio of zinc to silicon to phosphorus that is measured.

The solutions for electrodeposition may be prepared in various ways as shown in the following examples.

EXAMPLES FOR POLYMER PREPARATION

Example 1

An electroplating solution was prepared as follows: 50 g of silicon granules (20 mesh, 99.999%) was mixed with 252 ml $H_3PO_4$ (85%) and 520 ml deionized water in 1 liter beaker. The temperature of the solution was maintained at 30°–35° C. in an ice bath. 135 g of sodium hydroxide pellets were added in increments of 10 g every 15 minutes with gentle stirring. The total amount of time required is about 3.5 hours. 8 g of zinc granules were added to the solution. The solution was allowed to react without stirring for 5 days. The pH of the solution was found to be 2.97. A current density of 3.2 A/dm$^2$ was used to electrolytically co-deposit a coating on a steel substrate. A 10-micron layer of Zn/Si/P was deposited on the surface in about 20 minutes. An electron dispersive X-ray analysis (EDX) indicated the characteristic X-ray lines of zinc, silicon and phosphorus in the coating.

Example 2

Premix A was prepared by mixing 250 g of zinc with 126 ml $H_3PO_4$ (85%) and 360 ml of deionized water in a 1-liter beaker. The temperature of the solution was maintained at 30°–35° C. in an ice bath. The mixture was allowed to react for 1 hour. 85 g of potassium hydroxide (KOH) was added with gentle stirring in increments of 3 g every 15 minutes. The amount of time taken was about 6½ hours. The solution was allowed to react for 5 days.

Premix B was prepared by mixing 50 g of silicon granules with 126 ml $H_3PO_4$ (85%) and 360 ml of deionized water in a 1-liter beaker. The temperature was maintained at about 30°–35° C. by immersing the beaker in an ice bath. 115 g of KOH pellets in increments of 5 g every 15 minutes was added to the solution with gentle stirring. The solution (Premix B) was allowed to react for 5 days.

Premix A and Premix B were then mixed in a ratio of 1:1 by volume.

This mixture with a pH of 2.92 was used to coat a steel substrate by electrodeposition. The plated surface was then subjected to analysis by EDX which showed the presence of 82.2% by weight of zinc, 3.8% by weight of silicon and 14.0% by weight of phosphorus. The ratio of zinc:silicon:phosphorus is 82.2:3.8:14.0.

Example 2A

The above Premixes A and B were mixed in a ratio of 1:3 and used to electrodeposit a coating on a steel substrate. The pH of the solution was 3.25. EDX analysis of the coating revealed the presence of 72.6% by weight zinc, 8.8% by weight of silicon and 18.6% by weight of phosphorus. The ratio of zinc: silicon: phosphorus is 72.6: 8.8: 18.6.

Example 3

45 g zinc pellets, 5.7 g of granular silicon was mixed with 252 ml $H_3PO_4$ (85%) and 720 ml deionized water in a 1-liter beaker maintained at the temperature of 30°–35° C. 170 g of KOH pellets were added to the mixture in increments of 7 g every 15 minutes over a period of 6½ hours.

A 100 ml solution of 5.7 g Si and 40 g KOH were reacted for 4 hours. This solution was slowly added to the zinc/silicon/phosphoric acid mixture and allowed to react for 5 days.

A steel substrate was coated by electrodeposition in the above solution with a pH of 3.25. The surface of the plated substrate was analyzed by EDX and found to contain silicon, phosphorus and zinc.

Example 4

An electroplating solution in accordance with U.S. Pat. No. 4,117,088 was prepared as follows: 85 g of silicon lumps were washed with hydrochloric acid solution (HCl diluted 1:1 with water). The silicon was then filtered from the solution and added to a mixture of 50 ml of 85% $H_3PO_4$ solution and 200 ml of deionized water in a 1 liter beaker. The reaction was allowed to proceed for 2 days at 60° C. After this period, the silicon was filtered, and the concentration of silicon-containing species remaining in the solution was 44 g/l and the pH was 11.2. The pH of the solution was adjusted to 2.9 and the silicon concentration was adjusted to 1.3 g/l by adding 85% $H_3PO_4$ solution. A current density of 5 A/dm$^2$ was then used to pass a current through the solution using a copper cathode and a pyrolytic graphite anode. An EDX analysis indicated no characteristic X-ray line of silicon, and it was concluded that silicon-containing species were not electrodeposited from the solution.

Example 5

Premix A was prepared by mixing 150 g of silicon powder (20 mesh, 99.999%) with 1500 ml of concentrated ammonium hydroxide. Ammonia gas was bubbled slowly through the solution. 125 g NaOH pellets were added to the solution over a period of 3 hours in increments of about 3.5 every 5 minutes. The temperature of the reaction is controlled at 30°-35° C. for 48 hours.

Premix B was prepared by reacting 30 g of zinc powder in 250 ml of $H_3PO_4$ (85%) and 750 ml of deionized water. The solution is gently stirred for about 5 hours until all of the zinc has dissolved.

The electroplating solution is prepared by mixing Premix A and Premix B in a ratio of 1:3 with stirring.

EDX Analysis of the surface of a steel substrate electroplated in the above solution at pH 2.5 indicates the presence of 9% by weight of silicon, 3% by weight of phosphorus and the balance as zinc.

Example 6

Solutions were prepared in accordance with the methods described. The results are indicated in the following table.

| | | | Solution Composition | | | Coating Composition | | |
|---|---|---|---|---|---|---|---|---|
| Method | pH | Spec. Gravity | Zn g/l | P g/l | Si mg/l | Zn | Si | P |
| Example 1 | 2.97 | 1.250 | 7.4 | 110 | 240 | + | + | + |
| 2 | 2.92 | 1.154 | 8.3 | 70 | 60 | + | + | + |
| 2A | 3.25 | 1.158 | 4.1 | 60 | 90 | + | + | + |
| 3 | 3.25 | 1.148 | 5.2 | 60 | 2,250 | + | + | + |
| 4 | 2.48 | 1.122 | 14.5 | 51 | 625 | + | + | + |

Example 7

10 liters of $H_3PO_4$ (85%) and 10 liters of water were added to a 5 gallon reactor. Cooling water (10° C.) was run in the cooling water bath until the acid mixture has cooled to less than 25° C. 9 Kg of zinc metal granules were added to the acid mixture and allowed to react for 15 minutes. 168 grams of NaOH pellets were added every 15 minutes until 4.2 Kg total has been added. The solution mixture was controlled at 35° C. (30°-40°) for four days after which the clear solution containing the solubilized zinc is poured off.

A silicon premix solution was prepared as follows:

400 g granular silicon, 300 ml deionized water and 300 ml phosphoric acid (85%) were added to a 1-liter beaker. 30 g of NaOH pellets were added initially. A total of 480 g NaOH added in increments of 30 g every 15 minutes. The reaction temperature was controlled to 50° C. and the reaction carried out for 24 hours. The solution was diluted with water back to 1 liter. The clear silicon premix solution was poured off.

600 ml of silicon premix solution was slowly mixed into 20 liters of the zinc premix solution.

A steel substrate was electrocoated in the above solution. The surface analysis of the coating by EDX revealed zinc, silicon and phosphorus.

Example 8

A zinc premix solution was prepared: 980 kg of zinc nuggets were added to a stainless steel reactor. 1860 kg of 85% phosphoric acid and 1060 liters of water were mixed into the reactor with stirring. The cooling water of the reactor was turned on to maintain a temperature of 38° C. 23 kg. of caustic soda pellets were added to the reactor. Agitation was applied until the temperature was below 38° C. When a minimum of 15 minutes has passed, an additional 23 kg. of caustic were added and agitated. The addition and agitation repeated until a total of 460 kg. of caustic soda pellets have been added. The agitator was turned off and the solution was allowed to react for at least 84 hours. The clear solution was drained into drums.

The silicon premix was prepared as follows:

190 kg. of silicon granules were added to the polyethylene tank with 425 liters of water. 235 kg. of 85% phosphoric acid were mixed in the tank. 23 kg. of caustic soda pellets were added every 15 minutes until a total of 230 kg. have been added. The reaction temperature was maintained at 52°-74° C. by running cooling water through the reactor coils. The batch was held at 52°-74° C. for 24 hours. The clear solution was drummed out.

The plating solution was prepared by mixing the zinc premix solution and the silicon premix solution in a ratio of 12:1 with stirring. Analysis of the coating of a steel substrate using electrodeposition in the above solution indicates 94.7% by weight of zinc, 3.7% by weight of silicon and 1.6% by weight of phosphorus. The ratio of zinc: silicon: phosphorus is 94.7: 3.7: 1.6.

Metal parts can be coated by electrodeposition using any one of the above solutions at a pH in the range of about 2 to about 14, preferably about 2 to about 5, or about 8 to 14, the pH being adjusted with concentrated phosphoric acid or alkali metal hydroxide. The electroplating process is carried out at ambient room temperature, i.e., in a range of about 10 to 32° C. The metal substrate to be coated is connected as the cathode. The anode may be insoluble, e.g. carbon or precious metal coated titanium, or soluble, e.g. zinc. Generally the surface area of the anode to the cathode should be in a ratio of 1:1 or higher, placed about 7 cm to 18 cm apart preferably about 10 cm apart. The current density applied is in the range of about 0.5 to about 10 $A/dm^2$, preferably about 1.6 $A/dm^2$ to 4 $A/dm^2$. At about 3.2 $A/dm^2$, the amount of time needed to deposit a 10 microns layer is about 15 to 20 minutes.

The metal parts may be made of various metals selected from the group comprising steel, stainless steel, copper, zinc, aluminum and titanium.

Example 8A 770 grams of zinc metal nuggets and 19 grams of granular silicon metal were added to a reactor containing 1 liter of water. 400 ml of 85% phosphoric acid were slowly added to the mixture with constant stirring. The solution was allowed to proceed for 30 minutes. Then, 38 grams of sodium hydroxide was added every 30 minutes and the reaction was allowed to proceed with constant stirring. When the pH reached about 3, feed of NaOH was stopped. The reaction was allowed to proceed for 3 to 4 days. The solution was removed by decantation. This solution showed 11 g/l of zinc, 28 mg/l of silicon and 90 g/l of phosphorus.

A steel substrate was electrodeposited in the above solution. The surface analysis of the coating by EDX revealed 0.1% by weight of silicon, 0.5% by weight of phosphorus and 99.4% by weight of zinc.

Example 9

2.3 kg of zinc metal nuggets was added to a reactor with 3 liters of water, and 57 grams of granular silicon metal was added to the mixture. 1.2 liters of 85% phosphoric acid were slowly added with constant stirring over a ½ hour period. The reaction of phosphoric acid and zinc was allowed to proceed for another ½ hour. 114 grams of KOH were added every 30 minutes and reaction allowed to proceed with constant stirring and controlling the temperature of the reactor to between 21°-32° C. When the pH reached about 2, feed of KOH was stopped. The reaction was allowed to proceed for 3 to 4 days with the temperature at 90° C. or lower. As zinc granules reacted and went into solution the pH gradually climbed to about 3.5. After 3-4 days, the solution was removed by decantation. This solution was used to electrodeposit a steel substrate. EDX analysis of the electrodeposited surface detected the presence of zinc, silicon and phosphorus.

Example 10

400 ml of zinc concentrate as prepared in example 7 was added to 400 ml of D.I. water. 50% NaOH solution was added to raise pH to 7.0. Then 20 ml of the silicon concentrate as prepared in Example 7 was added. The pH was adjusted with 50% NaOH resulting in pH of 7.0 with a total volume of 1 liter.

Some white precipitate slowly settled out. Analysis showed zinc to be 0.20 g/l . A current density of 3.2 $A/dm^2$ was applied to a cathode immersed in the clear liquid for 15 minutes. A very thin white deposit was observed.

Example 11

25 ml of 50% NaOH was added to 800 ml of D.I. water. 20 ml of silicon concentrate as prepared in Example 7 was added to the alkali water. Then 40 ml of zinc concentrate as prepared in Example 7 was slowly added with stirring. A white precipitate slowly settled. The volume was adjusted to a total of 1 liter. pH of this solution was 13.5. The soluble zinc measured at 1 g/l. A current density of 3.2 $A/dm^2$ was applied for 15 minutes to the cathode immersed in this clear solution. A smooth dark gray deposit resulted.

Example 12

A solution was prepared by the method described in Example 11 of U.S. Pat. No. 4,117,088:

422.1 g of high purity silicon lumps were mixed with 800 g of deionized water. 200 g of sodium hydroxide pellets were added to the solution. The reaction temperature was kept at 53° C. for dissolution of silicon. A slow feed, drop by drop, of 85% phosphoric acid was added to the reaction vessel. The phosphoric acid feed was stopped when the pH reached about 12. The reaction was allowed to proceed for 14 hours. Heat was removed and more phosphoric acid was added. The reaction was allowed to react overnight. The pH was 10.8. The solution was used to plate on a steel panel. There was no visual coating observed. EDX also did not detect any silicon on the panel.

A zinc premix solution was prepared according to the procedure described in Example 8. This zinc premix solution was added to the silicon solution described above.

The plating solution thus prepared deposited a coating on the steel substrate. Analysis of the coating by EDX indicates the presence of zinc, silicon and phosphorus.

EXAMPLES SHOWING IMPROVED CORROSION RESISTANCE

Example 13

Five test cups made of iron were coated by electrodeposition in a solution prepared according to the procedure described in Example 9.

The five coated cups were cleaned by successive dipping and washing in Hexane and allowed to air dry. Three of the cups were dipped in Ferrocote 366 oil. All of the cups were placed in a humidity cabinet and subjected to a standard 30-day humidity cycle. After 30 days, the cups were removed and visually inspected.

The coated cups, both with and without Ferrocote oil coating, successfully passed the 30-day humidity cabinet test. There was no evidence of any iron rusting on the five cups. Several of the coated cups did show a soft white deposit in several areas. Under normal conditions and using the Ferrocote 366 mixture, some corrosion would have been expected. This did not occur with the coated cups.

The electrodeposition appears to have pacified the iron surface, since no corrosion was observed even in areas where the surface coating was badly scratched.

Example 14

Samples of $1\frac{1}{8}''$ diameter$\times 8''$ ASTM A-193 B7 stud bolts with ASTM A-194 grade 2H nuts were electrolytically coated to provide a zinc-silicon-phosphorus coating layer of 8 microns in thickness. The bolts and nuts were torqued to 100% of minimum yield strength in a simulated flange fixture incorporating a strain gauged load cell for load monitoring. After this, the five bolts and nuts were placed in an ASTM B-117 salt fog test chamber for corrosion testing. Two bolts with nuts were removed after 300 hours; one bolt with nut was removed after 700 hours; another bolt with nut was removed after 1000 hours and the final bolt was removed after 1350 hours. Results of the salt fog tests were as follows:

After 300 hours, no visible corrosion product was observed.

After 700 hours, no visible corrosion was observed.

After 1000 hours, slight surface corrosion was present; however, pitting of the steel substrate was not observed.

After 1350 hours, the bolt threads were filled with salt residue and/or corrosion products. The residue was easily removed, and no gross deterioration of the fastener was observed. There was some minor corrosion pitting. However, on testing, it was found that the strength of the fastener has not been reduced by the minor corrosion found.

Example 15

Four $2''\times 3''$ 1010 low carbon steel panels were electrodeposited in a solution described in Example 7. An acid zinc coated 1010 steel was chromated and used as a control panel. All five panels were exposed to salt fogging as described in ASTM B117 test procedures, for 1,000 hours or until there was sufficient apparent degradation to warrant close examination. After an exposure of 700 hours, the control panel exhibited apparently severe corrosion over 90% of its surface, while the Zn/Si/P coated panels were discolored over about 70% of the surface areas. Upon close examination, the nature and extent of the corrosion at the surfaces were found to differ. On the control panel, numerous pits, up to about 2.5 mm deep, were found. Further, wherever red iron oxide was observed on the surface, the underlying steel showed signs of pitting due to corrosion. By contrast, on the Zn/Si/P coated panels, no pits deeper than about 5.3 microns were found. Many areas of the coating were stained red by iron oxide, but there was no corrosion damage of the steel substrate. It appears that corrosion products from small areas made it appear as if large areas have been severely affected.

EXAMPLES ILLUSTRATING IMPROVED WEAR RESISTANCE

Example 16

A Timken block was coated electrolytically in a solution described in Example 9. The lubricity measurement was performed using the coated block and an uncoated ring, which were immersed in 15W-40 grade motor oil during the test. The ring and block did not seize at the maximum torque of the Timken Tester, i.e., 410 in.-lb., after which the test was terminated. Results are shown in FIG. 3, a graph plotting torque vs. weight loss.

Example 17

Three sets of Timken blocks and rings were tested on the Timken Tester and were identified as follows:

#1 Uncoated ring and block
#2 Coated ring—uncoated block
#3 Coated ring and block The pieces were electrolytically coated in a solution described in Example 1.

The loss of weight of the block in milligrams was plotted against the torque meter reading, giving a visual indication of the rate of wear and the torque value at which the scoring of parts was observed. No scoring of any of the three samples was observed at 320 in.-lbs. Scoring of the uncoated ring and uncoated block started to appear at 350 in-lbs. The coated ring and uncoated block showed a steady rate of wear but did not score even at the maximum torque of the Timken instrument. The coated ring and coated block also showed a steady but higher wear rate. There was some evidence of scoring at the maximum torque of 410 in-lbs.

EXAMPLES ILLUSTRATING IMPROVED GALLING RESISTANCE

Example 18

Four Timken blocks were coated by electroplating from a solution decribed in Example 9. They were tested on the Timken Test Machine.

The four treated blocks and one untreated block, for comparison, were tested on the Timken Test Machine using the "oil-off" procedure. All tests were performed using a standard untreated T48651 test cup.

The cup and block were mounted in the Test Machine and flooded with lubricant (Mobil Jet II oil, 100° F. inlet temperature). The Test Machine was started and the speed adjusted to 1200 rpm.

Loads were added at a rate of one pound per minute until the total weight was ten pounds. A baseline running torque was established.

After a ten minute "run-in", the oil flow was stopped and residual oil at the cup-block interface was purged using an air nozzle.

The machine was then run until the torque had increased to ten inch-pounds above baseline or reached a total running time of 50 minutes.

The "oil-off" test blocks (four treated and one untreated) were started with an initial no load running torque of 12 lb-ft/in. with a range of 19 to 22 lb-ft/in. The torque remained fairly constant during the ten minute "run-in" portion of the test.

Almost immediately upon removal of the oil flow, there was a drop in running torque of one to two lb-ft/in. in all of the runs. The untreated block exceeded the 10 lb-ft/in. criteria within $1\frac{1}{2}$ minutes and was terminated. The treated blocks ran an average of 14.5 minutes under the no load condition. None of the wear patterns on the treated blocks reached the depth or width observed on the untreated block.

Example 19

Four standard A.P.I. (American Petroleum Institute) L-80 couplings ($2\frac{3}{8}'$ OD & $2\frac{7}{8}'$ OD) were electrolytically coated in solution as described in Example 1. They were doped with regular A.P.I. pipe on a regular "buck-on" machine to 800 lbs. torque and standard A.P.I. stand off. The couplings were then removed and inspected. No galling was apparent on the pin or the coupling. This operation was repeated eight times without any observed galling.

Example 20

A $2\frac{3}{8}''$ L-80 coupling and a pin were coated by electrodeposition in a solution as described in Example 2. The coupling and pin were doped and buck on and off a L-80 pipe 4 times. No apparent galling or damage to threads was observed.

Example 21

A $2\frac{7}{8}''$ L-80 coated coupling and coated pin were plated from a solution described in Example 2. They were undoped and bucked on and off one time with no apparent galling. Coupling was overtorqued on the second run and resulted in severe galling.

Example 22

A set of threaded components 1-5/16 through 18 UNEF-2 were plated from the solution described in Example 7. The coated set was subjected to torsional/-loading to about 120 ft. to the pound. There was no thread galling when the components were unscrewed.

A set of uncoated set was loaded to about 40 ft. to the pound. When the uncoated component was unscrewed, the threads galled. It appeared that the coefficient of friction had been reduced for the coated components.

Example 23

Five samples of $1\frac{1}{8}''$ diameter$\times 8''$ long ASTM A-193B7 stud bolts with ASTM A-194 grade 2-H nuts were plated with Zn/Si/P coating of 8 microns thick. The bolts and nuts were mechanically tested by applying a torque to 100% of minimum yield strength. After this, the five bolts and nuts were placed in an ASTM B-117 salt fog test chamber for corrosion testing. Two bolts with nuts were removed after 300 hours. The nuts turned freely by hand along the entire length of the bolt. One bolt with nut was removed from the fog chamber after 700 hours. The nut also turned freely by hand along the entire length of the bolt. The set of bolt and nut removed after 1000 hours had a prevailing breakout torque on the order of 20 to 35 ft. lbs. After starting, the nut could be turned easily by hand. The final bolt threads removed after 1350 hours were filled with salt residue and/or corrosion products. The nut was easily removed from bolt. The nut could not be threaded on other areas of the bolt which were not protected by the nut during testing.

EXAMPLES ILLUSTRATING IMPROVED STRESS CORROSION CRACKING RESISTANCE

Example 24

ASTM A-194 Grade 2-H thread stud bolts ($1\frac{1}{8}'' \times 8''$) steel were coated electrolytically in a solution prepared according to the procedure described in Example 8, using a current density of 3.2 A/dm$^2$. Two test blocks of hardened 4140 steel, in which $1\frac{1}{4}''$ holes had been bored, were clamped together. Four (4) of the bolts were installed in the test block at 1,800 ft. of torque which creates 85,000 pounds load. The test block created a stress length of 4" in each of the four bolts. The test assembly was then wetted with tap water and placed on the ground outside for 14 days. There was no evidence of stress corrosion cracking during this period. The assembly was then installed in a 100% condensing humidity cabinet at 35° C. and remained there for 9 days. The assembly was then removed and returned to the outside environment for 14 days. No indication of any cracking in the material was observed.

Example 25

Threaded stud bolts made of 4140 Steel were coated electrolytically in a solution prepared according to the procedure described in Example 7. An attempt to promote stress corrosion cracking failure was done by dissembling the fixture described in Example 24, removing the studs, greasing the threads, and re-assembling the fixture using the original bolt which had been previously exposed in Example 24, and retorquing until the nut threads galled and further torquing could not be accomplished. The bolts did not crack or fail and the test was suspended.

Example 26

Eight tensile tests were conducted on P-110 casing steel (yield strength, 128 psi) in accordance with NACE Standard TM-01-77. Four of these specimens were coated by electrodeposition in a solution described in Example 8. The other four specimens remained uncoated. Samples were prepared and tested using the NACE Standard.

During start-up, the NACE solution (5% NaCl, 0.5% Acetic Acid in distilled water saturated with $H_2S$ at 75° F. and 15 psi) in which the coated casings were immersed turned milky when $H_2S$ was introduced. The solution with the uncoated specimens remained clear. It appeared that $H_2S$ may have reacted with the zinc-/silicon/phosphorus coating to cloud the solution.

Four stress levels were tested. The results are shown below:

| Stress (%) | Specimen | Time to Failure (hrs) |
|---|---|---|
| 80 | coated | 7.3 |
| 80 | uncoated | 1.6 |
| 60 | coated | 13.5 |
| 60 | uncoated | 2.5 |
| 40 | coated | 21.7 |
| 40 | uncoated | 4.6 |
| 20 | coated | NF |
| 20 | uncoated | 20.2 |

NF = no failure

Figure 4:
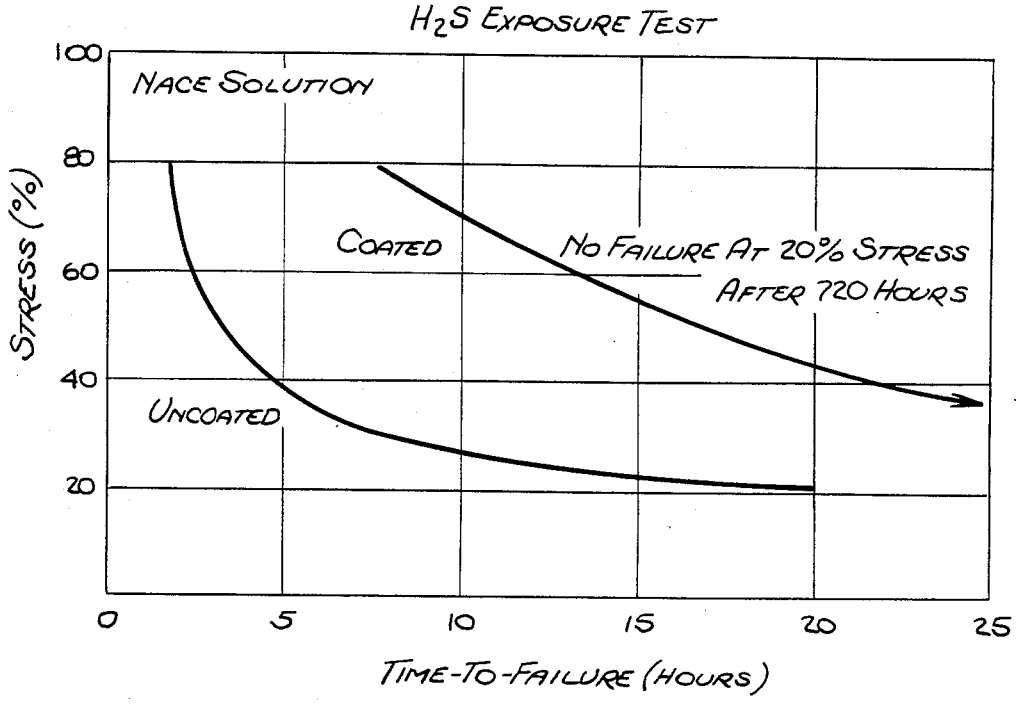
FIG. 4 is a graph plotting degree of stress versus time-to-failure in hours for coated and uncoated casing material after these have been subjected to various stress levels. The upper curve is the result obtained for a coated casing, the lower curve is the result obtained for an uncoated casing.

It is evident that the coating extended the time to failure of this particular material. Consistently, at all stress levels examined, the coated specimens had longer time-to-failure than uncoated specimens. See FIG. 4.

Example 27

Weight loss corrosion coupons of three standard steels: AISI 4130, 9Cr-1Mo, and AISI 410 were exposed to NACE solution (5% NaCl, 0.5% Acetic acid in distilled water saturated with $H_2S$ at 75° F. and 15 psi). Samples were exposed for a period of thirty days. Corrosion rates, as measured by weight loss, were calculated from specimen weight measurements made before and after exposure. Sample dimensions were 1-inch $\times$2-inches$\times$1/16-inch. Multiple samples of materials were coated with Zn/Si/P coating. All coated samples were tested simultaneously. Uncoated samples were exposed to NACE solution in a separate vessel.

Figure 5:
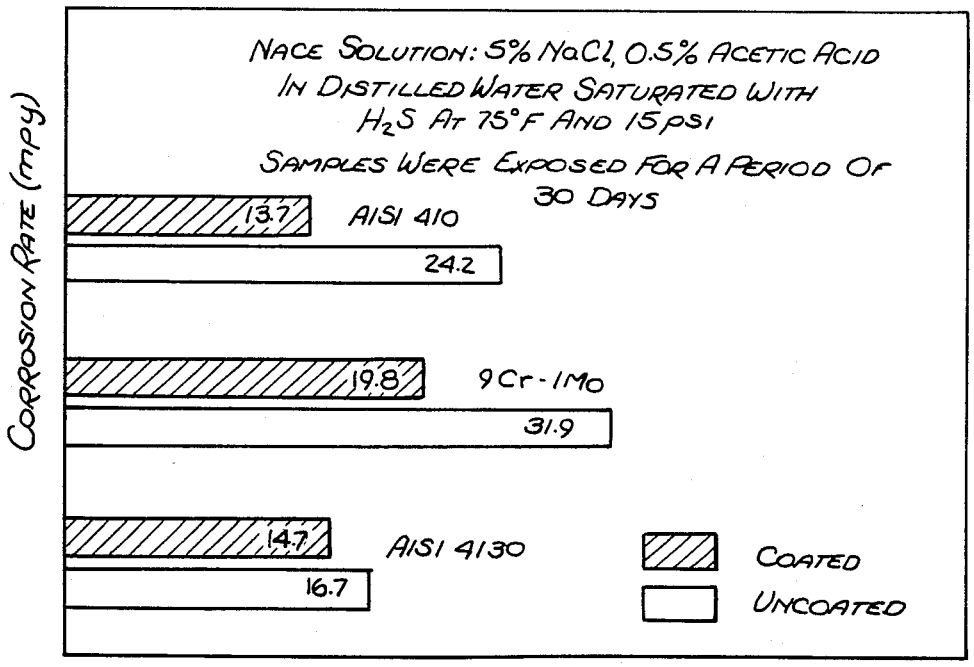
FIG. 5 is a graph comparing the corrosion rate (mpy=mils per year) of coated and uncoated metal specimens made of AISI 410, 9Cr-1MO and AISI 4130, steels.

The results of the corrosion tests are shown in FIG. 5. For AISI 4130, the average corrosion rates for the coated samples were approximately the same as the uncoated AISI 4130. The average corrosion rates for the coated 9Cr-1Mo and AISI 410 were generally lower than those found for the uncoated samples. pH measurements of the solution made after the completion of the test revealed that the pH of the solutions from the two tests involving the coated and uncoated samples were approximately the same (pH=3.7). This suggests that any differences in corrosion behavior were not the result of pH differences that may have been caused by the coating or the corrosion products.

Example 28

A single tensile test was conducted in NACE solution by methods in accordance with NACE Standard TM-01-77. The material was P-110 (Y.S.=128 psi). The specimen was coated with Zn/Si/P by electrodeposition and stressed to 80% of the material yield strength.

The time-to-faliure of the coated tensile specimen of P-110 was 15.0 hours. This is substantially longer than those found for the uncoated specimen and coated specimen tested in Example 23 at 80 percent of yield stress.

EXAMPLES ILLUSTRATING ADHERING COATING ON DIFFICULT TO PLATE METALS

Example 29

Five 4 inch$\times$5 inch 304 stainless steel sheets were alkaline degreased, immersed in phosphoric acid solution, and electroplated with the Zn/Si/P coating from a solution described in Example 8. The adhesion of the deposited coating on the stainless steel substrate was tape tested. All showed good adhesion.

Example 30

Five 304 stainless steel sheets ($4'' \times 5''$) were treated by nitric acid to passivate the surface (a common treatment to prevent adhesion of electroplated metal to the substrate). These passivated stainless steel sheets were electrodeposited with a Zn/Si/P coating from the solution described in Example 8. A thick coating of more than 25 microns was deposited. Edges of the coating were cut by a sharp razor. It was not possible to peel off the coating from the substrate.

The surfaces of another five sample sheets were further passivated by anodic current and electrolytically deposited with Zn/Si/P coating. Again no coating could be peeled from the substrate. The coated stainless steel samples were forced to bend and stretch many times. No peeling or breaking in the coating was observed.

Example 31

Five 2 inch×3 inch 5052 aluminum coupons were alkali degreased and immersed in acid without any special treatment. They were electrodeposited with a Zn/Si/P coating from the solution described in Example 7. The coupons were tape tested and bend tested. No peeling of the coating from the aluminum substrate was observed.

It is to be understood that the examples are illustrative in nature and are not to be construed in a limiting sense. It is recognized that various modifications are possible within the scope of the invention claimed.

What is claimed is:

1. A method to provide a solution suitable for electrodepositing a coating comprising at least about 70% by weight of zinc, at least about 0.1% by weight of silicon, and at least about 0.5% by weight of phosphorus on a metallic substrate, the method comprising:

(a) contacting metallic zinc and silicon with phosphoric acid and an alkali metal hydroxide until between 0.4 and 1.3 moles of alkali metal hydroxide per mole of phosphoric acid has been added;

(b) allowing the reaction to proceed until gas evolution ceases;

(c) removing residual metallic zinc and silicon from the solution; and (d) adjusting the pH to 2.5 or greater.

2. The method according to claim 1 wherein the reaction temperature is less than 75° C., and wherein between 0.6 and 0.9 moles of alkali metal hydroxide per mole of phosphoric acid are added.

3. The method according to claim 2 wherein the alkali metal hydroxide is added in the form of a solid.

4. A method of claim 3 wherein the pH is adjusted to a pH of about 2.

5. A method to provide a solution suitable for electrodepositing a coating comprising at least about 70% by weight of zinc, at least about 0.1% by weight of silicon, and at least about 0.5% by weight of phosphorus on a metallic substrate, the method comprising:

(a) contacting metallic zinc and silicon with phosphoric acid;

(b) adding an alkali metal hydroxide in increments to the zinc and silicon mixture such that the temperature of the reaction does not exceed the boiling point of the solution, and until between 0.4 and 1.2 moles of alkali metal hydroxide per mole of phosphoric acid has been added;

(c) Allowing the reaction to proceed until gas evolution ceases;

(d) removing residual metallic zinc and silicon from the solution; and (e) adjusting the pH to 2.5 or greater.

6. The method according to claim 5 wherein the reaction temperature is less than 75° C., and wherein between 0.6 and 0.9 moles of alkali metal hydroxide per mole of phosphoric acid are added.

7. A method of producing a solution suitable for electrodeposition to provide a coating containing at least about 70% by weight of zinc, at least about 0.1% by weight of silicon, and at least about 0.5% by weight of phosphorus on a metallic substrate, the method comprising:

(a) contacting metallic zinc with phosphoric acid and an alkali metal hydroxide until between 0.4 and 1.3 moles of alkali metal hydroxide per mole of phosphoric acid has been added;

(b) allowing the reaction to proceed until the pH is in the range of about 1.5 to 4; and, (c) removing the residual metallic zinc from the solution;

(d) contacting metallic silicon with phosphoric acid and an alkali metal hydroxide until between 0.2 and 0.4 moles of phosphoric acid per mole of alkali metal hydroxide has been added;

(e) allowing the reaction to proceed until the pH reaches between 10 and 12; and, (f) removing residual metallic silicon from the solution;

(g) adding the silicon-containing solution to the zinc-containing solution such that the ratio of zinc to silicon is in the range of 8:1 to 30:1; and (h) adjusting the solution pH to 2.5 or greater.

8. The method of claim 7 wherein the alkali metal hydroxide is in the form of a solid.

9. The method of claim 7 wherein the solution pH is adjusted to about 3.

10. A method of producing a solution suitable for electrodeposition to provide a coating containing at least about 70% by weight of zinc, at least about 0.1% by weight of silicon, at least about 0.5% by weight of phosphorus on the metallic substrate, the method comprising:

(a) contacting metallic zinc with phosphoric acid;

(b) adding an alkali metal hydroxide in increments to react with the zinc such that the temperature of the reaction mixture does not exceed the boiling point of the solution, and until between 0.4 and 1.3 moles of alkali metal hydroxide per mole of phosphoric acid has been added;

(c) allowing the reaction to proceed until the pH is in the range of about 1.5–4; and, (d) removing the residual metallic zinc from the solution;

(e) contacting metallic silicon with an alkali metal hydroxide solution in a separate container;

(f) adding phosphoric acid in increments to react with the silicon alkali metal hydroxide mixture such that the temperature of the reaction mixture does not exceed the boiling point of the solution and until between 0.2 and 0.4 moles of phosphoric acid per mole of alkali metal hydroxide has been added;

(g) allowing the reaction to proceed until the pH reaches 10–12; and, (h) removing residual silicon metal from the solution;

(i) adding the silicon-containing solution to the zinc-containing solution such that the ratio of zinc to silicon is in the range of 8:1 to 30:1; and (j) adjusting the solution pH to 2.5 or greater.

11. A method of electrodepositing a coating comprising at least about 70% by weight of zinc, at least about 0.1% by weight of silicon, and at least about 0.5% by weight of phosphorus on a metallic substrate, the method comprising:

(a) providing an aqueous solution for electrodeposition prepared according to claims 1, 5, 2, 6, 3, 4, 7, 10, 8, or 9;

(b) cleaning the metallic substrate sufficiently to achieve an adherent electrodeposit on the substrate;

(c) immersing the cleaned substrate in the electroplating solution; and (d) electrodepositing the coating with the substrate as a cathode at a current density of at least 0.5 $A/dm^2$.

12. The method of claim 11 wherein the electrodeposition of the coating is carried out using a cathodic current density in the range of about 1.6 to about 4 $A/dm^2$.

13. A metallic article provided with an electrodeposited coating according to the methods of claim 11, said coating comprising about 70% to about 99.5% by weight of zinc, about 0.1% to about 10% by weight of silicon, and about 0.5% to about 20% by weight of phosphorus, thus providing a coating with improved corrosion, galling, wear and stress corrosioncracking resistance.

14. A metallic article according to claim 13, wherein the coating comprises about 90% to about 96% by weight of zinc, about 2% to about 5% by weight of silicon, and about 2% to about 5% by weight of phosphorus.

15. A metallic article according to claim 13, wherein the coating comprises zinc, silicon, phosphorus with the weight ratio of zinc: silicon: phosphorus in the range of about 90:5:5 to about 96:2:2.

16. A method of producing a solution suitable for electrodepositing the coating of claim 15, the method comprising:

(a) contacting metallic zinc with phosphoric acid and sodium hydroxide until 0.7 moles of sodium hydroxide per mole of phosphoric acid has been added;

(b) allowing the reaction to proceed until the pH is in the range of about 2.0 to 2.3;

(c) removing the residual metallic zinc from the solution;

(d) contacting metallic silicon with phosphoric acid and sodium hydroxide until 0.3 moles of phosphoric acid per mole of sodium hydroxide has been added;

(e) allowing the reaction to proceed until the pH reaches 11;

(f) removing residual metallic silicon from the solution;

(g) adding the silicon-containing solution of the zinc-containing solution such that the ratio of zinc to silicon is 14:1; and (h) adjusting the solution pH to 2.8.

17. A metallic article according to claim 13, wherein the coating comprises about 93% by weight of zinc, about 4% by weight of silicon, and about 3% by weight of phosphorus.

18. A metallic article according to claim 13, wherein the coating comprises zinc, silicon and phosphorus wherein the weight ratio of zinc: silicon: phosphorus is 93:4:3.

19. A method to provide a solution suitable for electrodepositing a coating comprising at least about 70% by weight of zinc, at least about 0.1% by weight of silicon, and at least about 0.5% by weight of phosphorus on a metallic substrate, the method comprising:

(a) contacting metallic zinc and silicon with phosphoric acid and an aqueous solution of ammonia until between 0.4 and 1.3 moles of ammonia per mole of phosphoric acid has been added;

(b) allowing the reaction to proceed until gas evolution ceases;

(c) removing residual metallic zinc and silicon from the solution; and (d) adjusting the pH to 2.5 or greater.

* * * * *

UNITED STATES PATENT AND TRADEMARK OFFICE

CERTIFICATE OF CORRECTION

PATENT NO. : 4,533,606
DATED : August 6, 1985
INVENTOR(S) : Yu-Ling Teng, Charles McCoy, Francis De Falco, Richard Mayernick It is certified that error appears in the above-identified patent and that said Letters Patent is hereby corrected as shown below:

In the Drawings:

Fig 2, in the title, delete "zinc/silicone phosphorous" and insert therefor -- zinc/silicon/phosphorus --.

Column 11, line 27, delete "4" and insert therefor --5--.

Signed and Sealed this

*Twelfth* Day of *November 1985*

[SEAL]

*Attest:*

DONALD J. QUIGG

*Attesting Officer*

*Commissioner of Patents and Trademarks*